US005899024A

United States Patent [19]

Stannard

[11] Patent Number: 5,899,024

[45] Date of Patent: May 4, 1999

[54] MANHOLE ADJUSTMENT RING

[76] Inventor: Edward C. Stannard, 3498 Southwood Ct., Davie, Fla. 33328

[21] Appl. No.: 09/002,424

[22] Filed: Jan. 2, 1998

[51] Int. Cl.[6] ..... E02D 29/14

[52] U.S. Cl. ..... 52/20; 404/26

[58] Field of Search ..... 52/19, 20; 404/26

[56] References Cited

U.S. PATENT DOCUMENTS

| | | | |
|---|---|---|---|
| 4,867,601 | 9/1989 | Bowman | 404/26 |
| 5,150,984 | 9/1992 | Bowman et al. | 404/26 |
| 5,209,601 | 5/1993 | Odill et al. | 52/20 X |
| 5,474,396 | 12/1995 | Bravo | 52/20 X |
| 5,496,128 | 3/1996 | Odill | 52/19 X |

*Primary Examiner*—Christopher Kent
*Attorney, Agent, or Firm*—Malloy & Malloy, P.A.

[57] ABSTRACT

A manhole adjustment ring to be disposed in a manhole frame having a surrounding side wall structure and an inwardly depending lip on which a manhole cover is supportably disposed, the manhole adjustment ring including a base frame and a spacer ring, with the base frame having a substantially continuous, rigid, ring like configuration structured to maintain substantially continuous, mating engagement with the manhole frame, while the spacer ring is adjustably coupled to the base frame and extends upwardly therefrom to a height sufficient to extend above the surrounding side wall structure of the manhole frame and define a protruding rim that accommodates a layer of pavement in generally abutting engagement with an exterior surface thereof. The spacer ring also includes an adjustable diameter and is structured to maintain secure, adjustable, coupled engagement with the base frame, while also being structured to expand to a diameter sufficient to engage the surrounding side wall structure of the manhole frame for generally secure engagement therewith and for generally secure retention of the base frame on the manhole frame, with the manhole cover being received supportably on the spacer ring and the base frame such that an upper surface thereof is generally flush with a top of the layer of pavement disposed in abutting engagement with the exterior surface of the protruding rim of the spacer ring.

17 Claims, 3 Drawing Sheets

FIG. 1
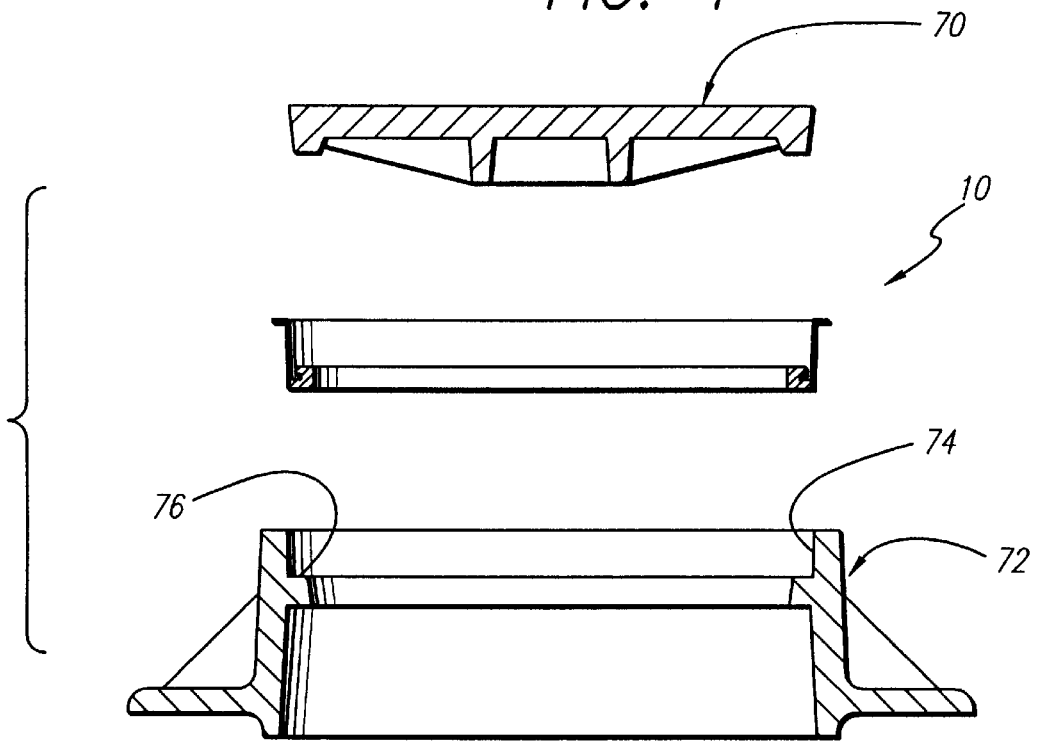
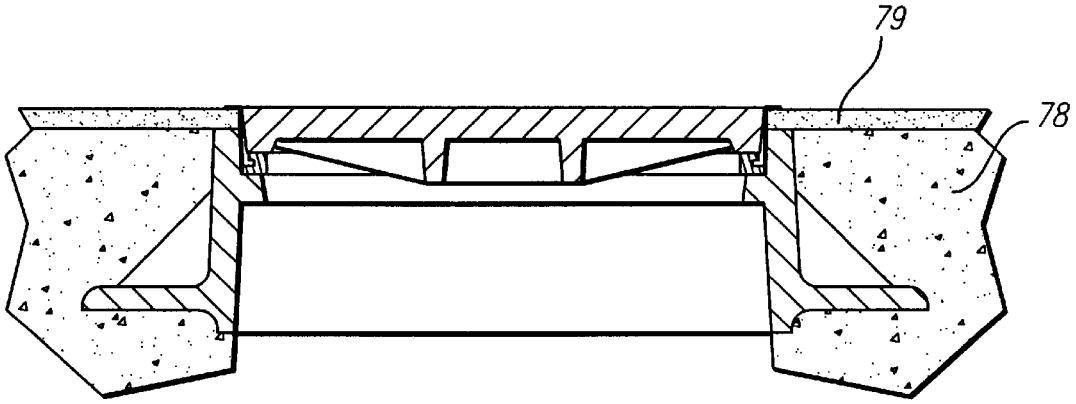
FIG. 2

MANHOLE ADJUSTMENT RING

BACKGROUND OF THE INVENTION

1. Field of the Invention

The present invention relates to a manhole adjustment ring structured to facilitate the rapid adaptation of an existing manhole frame to accommodate resurfacing of a road in which it is disposed. The manhole adjustment ring of the present invention is substantially quick and easy to install despite potential variations in the precise dimensions of the existing manhole frame, is substantially durable, does not rattle, minimizes water infiltration, and is capable of withstanding repeated jarring from passing vehicles, while effectively accommodating a manhole cover in an elevated position.

2. Description of the Related Art

Manholes are a commonly used access to underground passageways beneath roads or other paved locations. Typically, the manholes are bordered by a manhole frame onto which a large sturdy manhole cover is disposed. As often heavy volumes of traffic pass over the manhole cover during normal use, the manhole cover is generally quite heavy and durable, formed of cast iron or another strong metal, and is positioned so as to completely cover and shield the manhole itself. Moreover, the manhole frame is sized so that the manhole cover is supportably maintained flush with the paved surface into which the manhole frame is disposed, thereby providing a generally uniform surface over which vehicles may pass.

As the original manhole frame is also usually formed of a strong, durable metal, such as cast iron, and is permanently connected to underground pipes and tunnels, the useful life of the manhole frame and manhole cover will often far exceed the life of the paved road into which it is positioned. Accordingly, it is often the case that a road having one or more manholes disposed therein must be repaved/resurfaced without having to repair the manhole cover or manhole frame. Of course, repaving a road calls for the addition of a new layer of pavement atop existing layers, such additional layers of payment rising above the rim of the existing manhole frames and thereby necessitating replacement or modification of the manhole frame.

Very often, however, the new layer of pavement is not as thick as the necessary height of a new seat portion of the manhole frame, and complete replacement of the entire existing manhole frame is not a practical option. Accordingly, a variety of adjustment fixtures have been developed in order to partially raise the seating region of the manhole frame a sufficient height to effectively seat the manhole cover. Such adjustment fixtures are typically rigid structures that are sized to precisely fit within the existing manhole frame. Unfortunately, however, variations often exist in the precise dimensions of different manhole frames such that the exact fitting of each adjustment frame must be achieved relative to the manhole frame into which it is to be disposed. Indeed, even small differences in the needed dimensions can result in either an impossible fit, or a small gap between the adjustment frame and the original frame. Furthermore, while it may appear that a small gap is not of major significance, due to heavy traffic and large amounts of stress which such manhole frames must withstand, even the smallest of gaps can lead to rattling and eventually to the loosening and/or damaging of the adjustment frame. As a result, a very precise fitting adjustment frame is preferred. Also, given that the adjustment fixture must expand to almost the precise dimensions of the existing manhole frame so as to effectively receive the manhole cover, existing devices often require an added layer of pavement, or generally protrude from the pavement creating a road hazard and providing an exposed surface that is more susceptible to wear or damage from heavy traffic.

Others in the art have attempted to develop adjustment frames which include an adjustable construction/configuration. Typically, these adjustable frames include a large number of thick segments secured to one another in an adjustable form. Such segmented devices, however, are very difficult and time consuming to install with precision because of the many adjustment variables associated with a highly segmented construction, and often do not fully and/or sufficiently engage the existing manhole frame, even after a large amount of adjustment and manipulation. Furthermore, such segmented designs often leave large gaps which can lead to water infiltration, and more rapid rusting and deterioration of the manhole frame and adjustment frame. Additionally, the often large exposed area of adjustment frame and the gaps in its construction also provide a large number of vulnerable areas in the adjustment frame's configuration, which are susceptible to yielding and deflection upon repeated impacts from the passage of motor vehicles thereover.

Accordingly, there is still a substantial need in the art for a manhole adjustment ring which is substantially quick and easy to install to a precise, mating dimension required by an existing manhole frame. Moreover, such an adjustment ring should minimize water infiltration and should be constructed so as to be substantially durable by minimizing gaps in its construction, and minimizing exposed areas, while still providing secure, accessible fit and retention of the manhole cover itself. Also, such an adjustment ring should attain the necessary dimension rapidly so as to eliminate protrusion thereof and of the manhole cover above the new layer of pavement.

SUMMARY OF THE INVENTION

The present invention relates to a manhole adjustment ring. The manhole adjustment ring is structured to be utilized to modify a manhole frame of the type which typically includes a surrounding side wall structure and an inwardly depending lip so as to supportably receive and maintain a manhole cover. Preferably, the manhole adjustment ring of the present invention includes a base frame having a substantially continuous, rigid, ring-like construction that generally conforms to the dimensions of the inwardly depending lip of the manhole frame. Moreover, the base frame is also structured to be positioned in substantially continuous, mating engagement with the manhole frame, thereby minimizing fluid infiltration therebetween and maximizing a surface contact.

Extending generally upward from the base frame, and adjustably coupled thereto, is a spacer ring. In particular, the spacer ring includes an adjustable diameter and is structured to maintain secure, adjustable, coupled engagement with the base frame during all phases of use. Moreover, the spacer ring is also structured to expand to a diameter sufficient to matingly engage the surrounding side wall structure of the manhole frame, applying some outward pressure thereon to ensure a secure fit. As such, the spacer ring is able to provide generally secure engagement with the surrounding side wall structure of manhole frame upon expansion to the diameter sufficient to engage the surrounding side wall structure, while also providing for secure retention of the base frame on the manhole frame.

Preferably the spacer ring includes a height sufficient to extend above the surrounding sidewall structure of the manhole frame, thereby defining a protruding rim. The protruding rim of the spacer ring is structured to accommodate a new layer of pavement in generally abutting engagement with an exterior surface thereof, thereby allowing for the resurfacing of a road. Moreover, the spacer ring is structured to supportably receive the manhole cover therein so that an upper surface of the manhole cover is generally flush with the top of the new layer of payment disposed in abutting engagement with the exterior surface of the protruding rim of the spacer ring.

It is an object of the present invention to provide a manhole adjustment ring which can be precisely and securely fitted into manhole frames exhibiting minor variations in their actual diameter.

Still another object of the present invention is to provide a manhole adjustment ring which provides generally secure mating engagement with a manhole frame so as to minimize water seepage therebetween and so as to eliminate rattling and movement which often leads to premature wear and/or dislodging of the adjustment ring.

Still another object of the present invention is to provide a manhole adjustment ring which has a minimal, exposed surface area that is susceptible to repeated impacts from passing vehicles, but which securely retains a manhole cover in a substantially stationary orientation.

Also an object of the present invention is to provide a manhole adjustment ring which is substantially quick and easy to install to a needed dimension without complex tools or installation devices.

Also an object of the present invention is to provide a manhole cover adjust ring which is substantially durable, and which can accommodate varying thicknesses of new pavement layers, including multiple layers, without substantial modification thereto for each installation location, and while minimizing the minimum pavement thickness required to be concealed and/or flush with the pavement surface.

BRIEF DESCRIPTION OF THE DRAWINGS

For a fuller understanding of the nature of the present invention, reference should be had to the following detailed description taken in connection with the accompanying drawings in which:

FIG. 1 is an exploded cross-section view of the manhole adjustment ring of the present invention;

FIG. 2 is an assembled cross-sectional view of the manhole adjustment ring of the present invention in position within a manhole frame;

Like reference numerals refer to like parts throughout the several views of the drawings.

DETAILED DESCRIPTION OF THE PREFERRED EMBODIMENT

Figure 3:
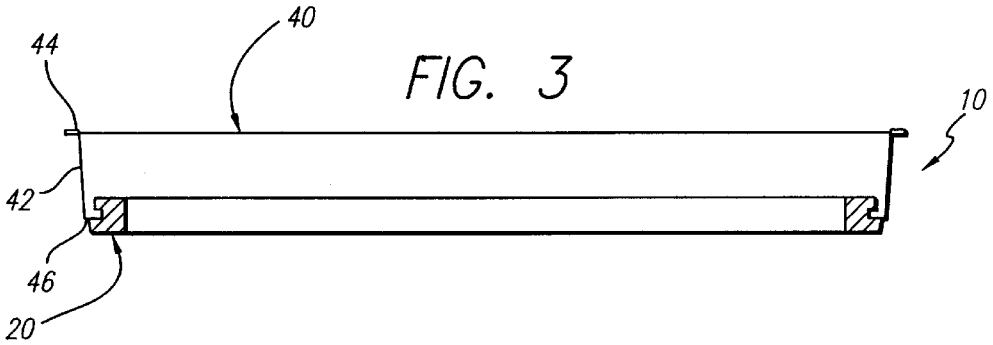
FIG. 3 is an isolated cross-section view of an assembled manhole adjustment ring of the present invention.
Figure 4:
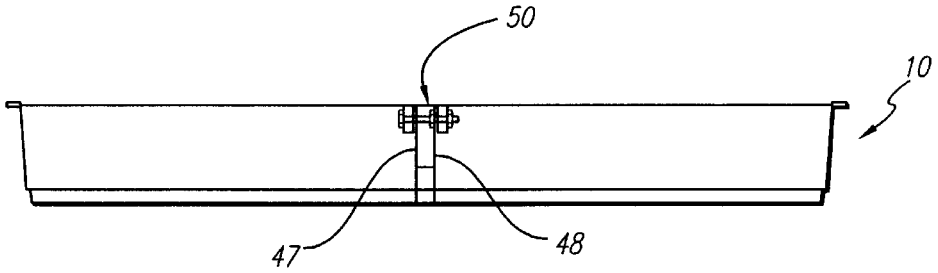
FIG. 4 is a side view of the manhole adjustment ring of the present invention.
Figure 5:
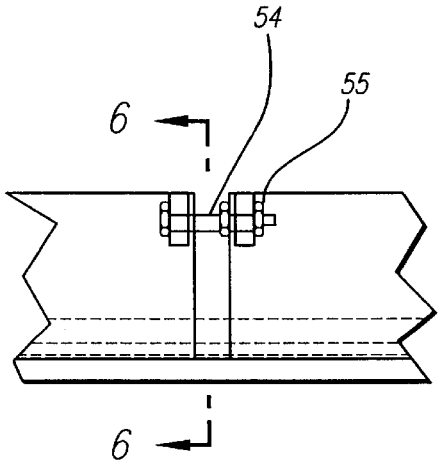
FIG. 5 is an isolated view of the adjustment means of the manhole adjustment ring of the present invention.
Figure 6:
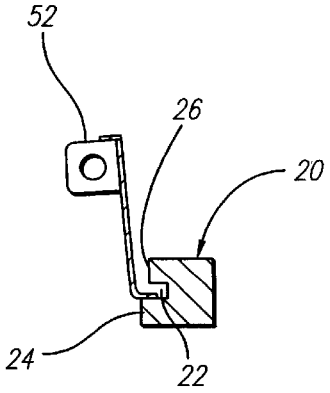
FIG. 6 is a cross-sectional view of the adjustment means along line 6—6 of FIG. 5.
Figure 7:
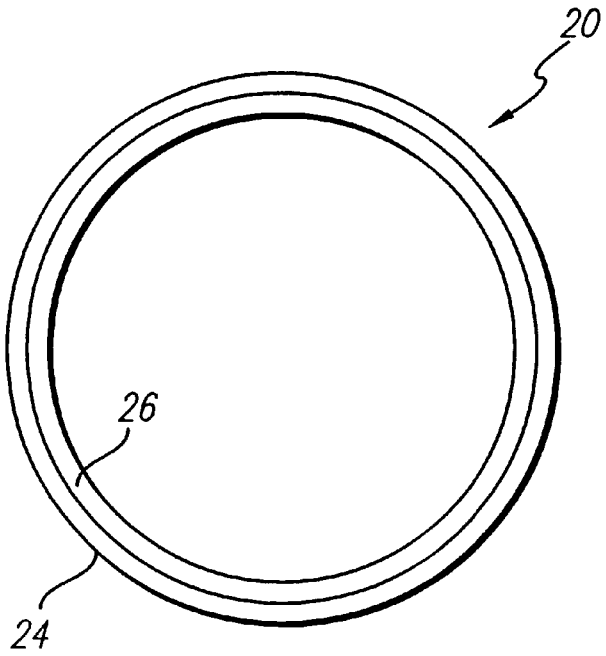
FIG. 7 is a top plan view of the base frame of the manhole adjustment ring of the present invention.
Figure 8:
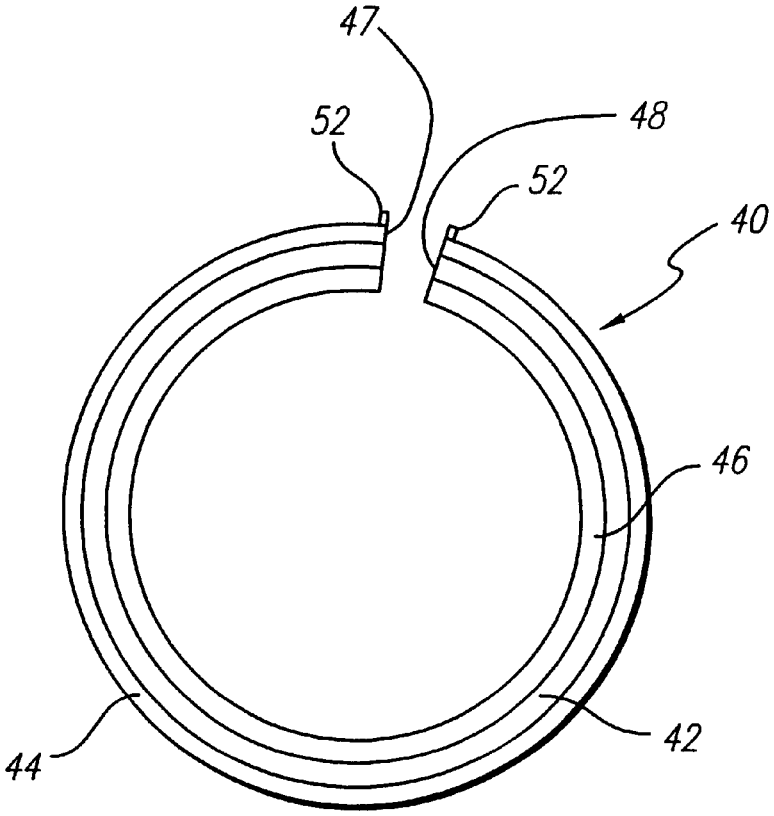
FIG. 8 is a top plan view of the spacer ring of the manhole adjustment ring of the present invention.

The present invention is directed towards a manhole adjustment ring, generally indicated as 10. Specifically, the manhole adjustment ring 10 is structured for use within an existing manhole frame 72 that defines a manhole access in a street or other paved surface. Typically, the manhole frame 72 is of the type which is connected with and underground access and includes, at an upper region thereof, a surrounding side wall structure 74 that conforms to the exterior dimensions of a manhole cover 70. Further, the surrounding side wall structure 74 of the manhole frame 72 is generally outwardly tapered, so as to accommodate and support the manhole cover 70 thereon, and terminates at an inwardly depending lip 76 of the manhole frame 72. Specifically, the inwardly depending lip 76 of the manhole frame 72 extends from the surrounding side wall structure 74 and receives the manhole cover 70 thereon so as to support a brunt of the weight of the manhole cover 70. As such, in actual use the manhole frame 72 is typically embedded in a layer of concrete or asphalt 78 so as to provide a generally flat continuous surface between the pavement 78, the manhole frame 72 and the manhole cover 70.

The manhole adjustment ring 10 of the present invention is structured for use when resurfacing of an area around the existing manhole frame 72 is to take place, the original flat, continuous surface between the pavement 78, the manhole frame 72 and the manhole cover 70 cannot be maintained, and the new layer of pavement is not of a sufficient thickness to accommodate a brand new seat or manhole frame 72. In particular, the manhole adjustment ring 10 preferably includes a base frame 20 and a spacer ring 40. The base frame 20 is preferably constructed of cast iron or another strong rigid material, and preferably includes a substantially continuous, rigid, ring-like configuration. Moreover, the base frame 20 is structured to be positioned in substantially continuous, mating engagement with the manhole frame 20, and in particular atop the lip 76 of the manhole frame 72. In this regard, the base frame 20 preferably includes an exterior diameter which is less than an interior diameter of the surrounding side wall structure 74 of the manhole frame 72 so that it may be completely introduced into the manhole frame 72 and can rest completely and directly atop the lip 76 of the manhole frame 72. Also, the complete, continuous engagement of the base frame 20 with the lip 76 of the manhole frame functions to provide a more secure, stable engagement, and to minimize fluid infiltration, thereby lessening the quantity of fluid which enters the underground sewage lines and must undergo the expensive treatment process, and helping to preserve the entire assembly from excessive corrosion. Furthermore, this outside diameter will preferably be of a configuration to correspondingly rest within manhole frames 72 which are imprecisely formed and may have variations in their precise diameters. Specifically, it is noted that conventional manhole frames 72 are not generally formed to exact dimensions, and as such, some variation with respect to the interior diameter of the surrounding side wall structure 74 or inwardly depending lip 76 may be present. Accordingly, the base frame 20 is configured of a small enough exterior diameter to be quickly and easily positioned within a variety of similarly dimensioned manhole frames securely and supportably. Moreover, an interior diameter of the base frame 20 is preferably such that it will not restrict access into and out the manhole itself when the manhole cover 70 has been removed.

As indicated, the manhole adjustment ring 10 of the present invention also includes a spacer ring 40. The spacer ring 40 is adjustably coupled to the base frame 20 so as to extend generally upward therefrom in generally confronting relation to the surrounding side wall structure 74 of the manhole frame 72 when the base frame 20 is positioned therein. In particular, the spacer ring 40 includes an adjustable diameter which can be varied to correspond the manhole frame 72 while still maintaining its secure, adjustable, coupled engagement with the base frame 20. Preferably, the spacer ring 40 is structured to first contract to a small enough diameter so as to facilitate introduction into the rigidly dimensioned manhole frame 72, and to subsequently expand to a diameter sufficient to preferably contact the surrounding side wall structure 74 of the manhole frame 72 in generally secure engagement therewith.

In the preferred embodiment, the spacer ring 40 includes a single, continuous, preferably thin and resilient material segment 42, such as formed from stainless steel. The segment 42 terminates in a pair of spaced, confronting ends 47 and 48 of the spacer ring 40. Of course, the confronting relation of the ends 47 and 48 is achieved due to a generally circular configuration into which the segment 42 is biased. As such, the adjustable spacing of the ends 47 and 48 of the spacer ring 40 from one another defines a select adjustable diameter of the spacer ring 40 to engage the surrounding side wall structure 74 of the manhole frame 72.

As referenced, the surrounding side wall structure 74 of the manhole frame 72 preferably includes an outward taper having its narrowest point at the lip 76. Similarly, preferably both an interior and an exterior surface of the spacer ring 40 is tapered outwardly away from the base frame 20 and expands to a diametric configuration that is generally equivalent to a diametric configuration of the surrounding wall structure 74 of the manhole frame 72. In this regard, an increase in the diameter of spacer ring 40 will effectively conform to and fully engage the surrounding side wall structure 74 of the manhole frame 72. Moreover, when the spacer ring 40 is in its select diameter which conforms to the diameter of the surrounding side wall structure 74 of the manhole frame 72, the interior diametric configuration of the spacer ring 40 is maximized such that the manhole cover 70 is supportably received in its necessarily somewhat loose, yet secure engagement structured to permit removal and replacement when access into the manhole is desired without wobbling. Indeed, it is seen that the outward taper, combined with the preferably thin construction of the spacer ring 40 are such that the dimensions of the surrounding side wall structure 74 of the manhole frame 72, which correspond the outside dimensions of the manhole cover 70, are reproduced with minimal protrusion of the spacer ring 40 above the manhole frame 72. Preferably, the manhole cover 70 supportingly rests on both the spacer ring 40 and the base frame 20 to maintain secure stable positioning.

The spacer ring 40 is structured to maintain, adjustable, coupled engagement with the base frame 20. In this regard, the spacer ring 40 includes an inwardly extending flange 46 that engages the base frame 20. While the inwardly depending flange 46 may extend only partially along a perimeter of the spacer ring 40, in the preferred embodiment the inwardly depending flange 46 extends completely along a lower edge of the spacer ring 40 for engagement with the base frame 20. In particular, the base frame 20 preferably includes a groove 22 disposed in an exterior perimeter thereof. The groove 22, which preferably extends completely about an entire exterior perimeter of the base frame 20, is structured to receive the flange 46 therein in order to maintain the adjustable, coupled engagement. Also, the groove 22 is sufficiently deep so as to accommodate variation in the diameter of the spacer ring 40. In the preferred embodiment, however, the base frame 20 includes an at least partially stepped exterior configuration so that a bottom ridge 24 that borders a lower side of the groove 22 extends radially outward beyond an upper ridge 26 that borders an upper side of the groove 22. Preferably, however, the upper ridge 26 defines a sufficient depth of the groove 22, and the flange 46 of the spacer ring 40 is itself of a sufficient depth, so as to remain engaged within the groove 22 even when the spacer ring's 40 diameter is maximized, while still permitting sufficient contraction of the diameter of the spacer ring 40. Moreover, the spacer ring 40 is further structured such that upon its being effectively sized and secured in secure engagement with the surrounding side wall structure 74 of the manhole frame 72, the flange 46 preferably engages an inner surface of the groove 22, such as at the bottom ridge 24, so as to retain and secure the base frame 20 in secure engagement with the lip 76 of the manhole frame 72. As such, wobbling and/or rattling between the manhole adjustment ring 10 and the manhole frame 72 is substantially minimized when a vehicle passes over the assembly and potentially abuts or engages the manhole adjustment ring 10. Further, due to the preferred, stepped configuration of the base frame 20, the substantially secure continuous, mating engagement between the base frame 20, and in particular the bottom ridge 24 of the base frame 20 with the lip 76 of the manhole frame 72, is substantially maximized, with an adjustability of the spacer ring 40 being correspondingly maximized due to the narrower diameter at the upper ridge 26 of the base frame 20 that allows a greater degree of contraction of the spacer ring 40 if a manhole frame 72 of a generally smaller diameter is required.

As indicated, a diametric configuration of the spacer ring 40 is adjustably maintained by adjustment means. In the preferred embodiment, the adjustment means are structured to secure the confronting ends 47 and 48 of the spacer ring 40 a select, spaced apart distance from one another so as to define the necessary diameter. As shown in the Figures, the adjustment means preferably includes a pair of retention segments 52 which are positioned in confronting relation to one another generally at the confronting ends 47 and 48 of the spacer ring 40. These retention segments 52 are preferably structured to receive an actuatable, threaded element 54 adjustably therethrough. For example, the threaded element 54 may include an elongate bolt which extends into a nut 55. As such, merely tightening the nut 55 functions to reduce the spacing between the retention segments 52, and accordingly the spacing between the confronting ends 47 and 48 of the spacer ring 40 to reduce an overall diameter of the spacer ring 40. Preferably the segment 42 of the spacer ring 40 is normally biased to expand, and must be affirmatively contracted to define a diameter equivalent to or smaller than the diameter of the manhole frame 72 at the surrounding side wall structure 74. As such, when the adjustment means are released so as to permit a diameter equivalent to or greater than that of the surrounding side wall structure 74 of the manhole frame 72, the normal bias and resilient tendencies of the spacer ring 40 normally urges the spacer ring 40 into a maximum diameter possible that abuts, engages and conforms to the surrounding side wall structure 74 of the manhole frame 72 to maintain the secure engagement therebetween. Indeed, in the preferred embodiment of the present invention, the adjustment means are more often utilized to maintain a compressed diametric configuration for facilitated introduction of the assembly into the manhole frame 72, with a subsequent release of the adjustment means providing for the effective, snug fit between the spacer ring 40 and the surrounding side wall structure 74 of the manhole frame 72. Of course, the adjustment means may incorporate correspondingly threaded or engaging retention segments such that affirmative spacing of the confronting ends 47 and 48 may be achieved if the resilient tendencies of the segment 42 of the spacer ring 40 maintains an insufficiently strong and secure engagement.

Looking further to the spacer ring 40, as indicated, it includes a height which is sufficient to extend above the surrounding side wall structure 74 of the manhole frame 70 when the spacer ring 40 is engaged with the base frame 20, and the base frame 20 is effectively seated on the lip 76 of the manhole frame 72. As such, a protruding rim 44 of the spacer ring 40 is defined above the manhole frame 72. It is this protruding rim 44 which accommodates an additional, new layer of pavement 79 to be positioned in generally abutting engagement with an exterior surface thereof when the street or locality is being repaved. Specifically, the manhole adjustment ring 10 of the present invention is positioned within an existing manhole frame 72 with the protruding rim 44 extending out above the manhole frame 72 and the existing pavement 78. Because of the thin, tapered construction of the spacer ring 40, the protruding rim 44 can be structured to be a minimal height required by the resurfacing job. As such, a new, minimal thickness layer of pavement may then be added into abutting engagement with an exterior surface of the protruding rim 44 to make a continuous surface. Moreover, the manhole adjustment ring 10 of the present invention, and in particular as a result of a height of the spacer ring 40 will receive and accommodate the manhole cover 70 such that an upper surface of the manhole cover 70 is generally flush with a top of the added layer of pavement 79. Also in the preferred embodiment, the spacer ring 40 is generally thin, and the protruding rim 44 of the spacer ring 40 is generally thin so as to provide a minimal exposed surface area at an upper edge of the spacer ring 40 and maximize the loose fit of the manhole cover 70. In this regard, once the pavement 79 has hardened and vehicles pass over the manhole cover 70 and the manhole adjustment ring 10, there is minimal exposed surface area to be engaged and thereby potentially dislodge or damage the manhole adjustment ring 10.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. To be disposed in a manhole frame having a surrounding side wall structure and an inwardly depending lip on which a manhole cover is supportably disposed, a manhole adjustment ring comprising:

a base frame, said base frame including a rigid, non-expandable, continuous configuration and being structured to be positioned in substantially continuous, mating engagement with the manhole frame, a spacer ring adjustably coupled to said base frame and extending generally upward therefrom, said spacer ring including an adjustable diameter and being structured to maintain secure, adjustable, coupled engagement with said base frame while also being structured to expand to a diameter sufficient to engage the surrounding side wall structure of the manhole frame for generally secure engagement therewith and for generally secure retention of said base frame on the manhole frame, said spacer ring including a height sufficient to extend above the surrounding side wall structure of the manhole frame and define a protruding rim, said protruding rim being structured to accommodate a layer of pavement in generally abutting engagement with an exterior surface thereof, and said spacer ring being structured to supportably receive the manhole cover therein such that an upper surface of the manhole cover is generally flush with a top of said layer of pavement disposed in abutting engagement with said exterior surface of said protruding rim of said spacer ring.

2. A manhole adjustment ring as recited in claim 1 wherein said base frame is structured to be supportedly disposed on the lip of the manhole frame in substantially continuous, mating engagement so as to minimize fluid infiltration therebetween.

3. A manhole adjustment ring as recited in claim 1 wherein said protruding rim of said spacer ring is generally thin so as to provide a minimal exposed surface area at an upper edge of said spacer ring and to maximize a loose, yet secure fit of the manhole cover therein.

4. A manhole adjustment ring as recited in claim 3 wherein said spacer ring is generally thin.

5. A manhole adjustment ring as recited in claim 3 wherein said spacer ring is formed of stainless steel so as to minimize corrosion thereof.

6. A manhole adjustment ring as recited in claim 1 wherein said exterior surface of said spacer ring is tapered outwardly away from said base frame so as to conform to the surrounding side wall structure of the manhole frame.

7. A manhole adjustment ring as recited in claim 1 wherein said interior surface of said spacer ring is tapered outwardly away from said base frame and expands to a diametric configuration structured to matingly receive the manhole cover therein and maximize a loose, yet secure engagement with the surrounding wall structure of the manhole frame.

8. A manhole adjustment ring as recited in claim 1 wherein said base frame includes a groove disposed at least partially about a perimeter thereof, and said spacer ring includes a flange structured to extend into said groove in order to maintain said secure coupled engagement with said base frame.

9. A manhole adjustment ring as recited in claim 1 wherein said base frame includes a groove disposed about an exterior perimeter of said base frame, and said spacer ring includes an inwardly extending flange, said inwardly extending flange extending into said groove and engaging an inner surface thereof so as to maintain said secure, adjustable coupled engagement between said spacer ring and said base frame, and so as to retain said base frame engaged with the manhole frame and to minimize wobbling and rattling thereof upon a vehicle passing over and engaging the manhole cover and the manhole adjustment ring.

10. A manhole adjustment ring as recited in claim 9 wherein said base frame includes an at least partially stepped exterior configuration such that a bottom ridge of said base frame which borders a lower side of said groove extends radially outward beyond an upper ridge of said base frame that borders an upper side of said groove, so as to maximize said continuous, mating engagement of said base frame with the manhole frame, while maximizing an adjustability of said spacer ring.

11. A manhole adjustment ring as recited in claim 9 wherein said flange of said spacer ring is sufficiently wide so as to remain at least partially within said groove of said base ring upon an expansion of said spacer ring to said diameter sufficient to engage the surrounding side wall structure of the manhole frame, thereby ensuring that said secure, adjustable coupled engagement with said base frame is maintained.

12. A manhole adjustment ring as recited in claim 11 wherein said base frame includes an at least partially stepped exterior configuration such that a bottom surface of said base frame provides maximum engagement with the lip of the manhole frame, while an upper surface of said base frame is sufficiently narrow to maximize an adjustability of said spacer ring.

13. A manhole adjustment ring as recited in claim 1 further including adjustment means structured to adjustably maintain said spacer ring at a select one of said adjustable diameters.

14. A manhole adjustment ring as recited in claim 13 wherein said spacer ring includes a pair of spaced, confronting ends, adjustably spaced from one another by said adjustment means so as to give said spacer ring said select one of said adjustable diameters.

15. A manhole adjustment ring as recited in claim 14 wherein said adjustment means includes a pair of retention segments disposed in confronting relation from one another at said confronting ends of said spacer ring, and an actuatable, threaded element adjustably extending through said retention segments so as to adjust the spacing therebetween.

16. A manhole adjustment ring as recited in claim 15 wherein said spacer ring is normally biased towards a maximum diameter.

17. To be disposed in a manhole frame having a surrounding side wall structure and an inwardly depending lip on which a manhole cover is supportably disposed, a manhole adjustment ring comprising:

a base frame, said base frame including a substantially continuous, rigid, ring like configuration and being structured to be positioned in substantially continuous, mating engagement with the manhole frame, a spacer ring adjustably coupled to said base frame and extending generally upward therefrom, said spacer ring including an adjustable diameter and being structured to maintain secure, adjustable, coupled engagement with said base frame while also being structured to expand to a diameter sufficient to engage the surrounding side wall structure of the manhole frame for generally secure engagement therewith and for generally secure retention of said base frame on the manhole frame, said spacer ring including a height sufficient to extend above the surrounding side wall structure of the manhole frame and define a protruding rim, said protruding rim being structured to accommodate a layer of pavement in generally abutting engagement with an exterior surface thereof, and said spacer ring being structured to supportably receive the manhole cover therein such that an upper surface of the manhole cover is generally flush with a top of said layer of pavement disposed in abutting engagement with said exterior surface of said protruding rim of said spacer ring, said base frame including a groove disposed about an exterior perimeter of said base frame, said spacer ring including an inwardly extending flange, said inwardly extending flange structured to extend into said groove, and said base frame including an at least partially stepped exterior configuration such that a bottom ridge of said base frame which borders a lower side of said groove extends radially outward beyond an upper ridge of said base frame that borders an upper side of said groove, so as to maximize said continuous, mating engagement of said base frame with the manhole frame, while maximizing an adjustability of said spacer ring.

* * * * *